US007703999B2

(12) United States Patent
Nishitani et al.

(10) Patent No.: US 7,703,999 B2
(45) Date of Patent: Apr. 27, 2010

(54) SHEET FEEDER, IMAGE-FORMING APPARATUS, AND IMAGE-READING APPARATUS

(75) Inventors: Hitoshi Nishitani, Ohta-ku (JP); Hideki Kawashima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 324 days.

(21) Appl. No.: 11/462,792

(22) Filed: Aug. 7, 2006

(65) Prior Publication Data

US 2007/0031173 A1 Feb. 8, 2007

(30) Foreign Application Priority Data

Aug. 8, 2005 (JP) ..... 2005-229554

(51) Int. Cl.
*B41J 11/58* (2006.01)
*B41J 13/10* (2006.01)
*B65H 9/00* (2006.01)

(52) U.S. Cl. ..... 400/624; 271/114; 271/115; 271/258.05

(58) Field of Classification Search ..... 400/578, 400/624–625, 628–629, 636; 271/114–116, 271/109, 119, 258.01, 258.05
See application file for complete search history.

(56) References Cited

U.S. PATENT DOCUMENTS 5,947,465 A * 9/1999 Kato et al. ..... 271/10.11

FOREIGN PATENT DOCUMENTS

| | | | |
|---|---|---|---|
| JP | 05-213487 | * | 8/1993 |
| JP | 3149139 | | 8/1993 |
| JP | 3120896 | | 12/1993 |
| JP | 9-40230 | | 2/1997 |
| JP | 2002-234636 | | 8/2002 |

* cited by examiner

*Primary Examiner*—Judy Nguyen
*Assistant Examiner*—Marissa L Ferguson-Samreth
(74) *Attorney, Agent, or Firm*—Canon USA Inc IP Div

(57) ABSTRACT

A sheet feeder includes first and second rollers, a power source, and first and second drive units. The first and second rollers can be independently rotated to apply a feeding force to a sheet. The sheet feeder can switch the first drive unit to a meshing state and the second drive unit to an escape state so as to input a rotational driving force from the power source to the first drive unit and can also switch the first drive unit to the escape state and the second drive unit to the meshing state so as to input the rotational driving force from the power source to the second drive unit.

24 Claims, 15 Drawing Sheets

FIG. 5

| FIRST INPUT GEAR 31 | SECOND INPUT GEAR 32 | ROTATIONAL DIRECTION OF POWER SOURCE 41 | ROTATIONAL DIRECTIONS OF ROLLERS 1 AND 2 | CORRE-SPONDING FIGURE |
|---|---|---|---|---|
| MESHING STATE | ESCAPE STATE | M | | FIG. 4A |
| | | M | | FIG. 4A (REVERSED) |
| ESCAPE STATE | MESHING STATE | M | | FIG. 4B |
| | | M | | FIG. 4B (REVERSED) |

FIG. 10

| FIRST DRIVE UNIT 71 | SECOND DRIVE UNIT 72 | ROTATIONAL DIRECTION OF POWER SOURCE 41 | ROTATIONAL DIRECTIONS OF ROLLERS 1 AND 2 | CORRE-SPONDING FIGURE |
|---|---|---|---|---|
| MESHING STATE | ESCAPE STATE | M | | FIG. 8A |
| | | M | | FIG. 8B |
| ESCAPE STATE | MESHING STATE | M | | FIG. 9A |
| | | M | | FIG. 9B |

FIG. 13

| FIRST DRIVE UNIT 71 | SECOND DRIVE UNIT 72A | ROTATIONAL DIRECTION OF POWER SOURCE 41 | ROTATIONAL DIRECTIONS OF ROLLERS 1 AND 2 | CORRE-SPONDING FIGURE |
|---|---|---|---|---|
| MESHING STATE | ESCAPE STATE | M | | FIG. 8A |
| | | M | | FIG. 8B |
| ESCAPE STATE | MESHING STATE | M | | FIG. 12A |
| | | M | DRIVE ANOTHER COMPONENT | FIG. 12B |

SHEET FEEDER, IMAGE-FORMING APPARATUS, AND IMAGE-READING APPARATUS

BACKGROUND OF THE INVENTION

1. Field of the Invention

The present invention relates to sheet feeders for feeding sheets such as recording media and documents, image-forming apparatuses including the sheet feeders, and image-reading apparatuses including the sheet feeders.

2. Description of the Related Art

Image-forming apparatuses for recording an image on a recording medium and image-reading apparatuses for reading an image from a document include a sheet feeder for feeding a sheet such as a recording medium or a document to, for example, an image-forming unit or a reading unit. Examples of image-forming apparatuses (or recording apparatuses) include printers, copiers, printing machines, fax machines, and multifunction devices and systems having such functions. Examples of image-reading apparatuses include scanners and multifunction devices and systems having a scanner function. In the present application, the term "image" should be broadly interpreted, including characters, symbols, lines, and patterns.

Typical sheet feeders for use in, for example, image-forming apparatuses and image-reading apparatuses feed a sheet in a direction parallel to the surface thereof (in a direction tangent to the surface thereof if the sheet is curved). Some sheet feeders can rotate a sheet about an axis parallel to a direction normal to the surface of the sheet. A first example of such sheet feeders feeds and rotates a sheet before image formation with an image-forming unit, as proposed in Japanese Patent Nos. 3120896 and 3149139. A second example rotates a sheet after image formation, as proposed in Japanese Patent Laid-Open Nos. 2002-234636 and 9-40230.

The sheet feeders of the known art are advantageous to some degree in terms of the size reduction of the entire apparatus and the increase in processing speed. These sheet feeders, however, require an additional sheet-rotating mechanism and a drive unit therefor which considerably complicate the structures and control systems of the sheet feeders.

SUMMARY OF THE INVENTION

The present invention is directed to a simple, compact sheet feeder capable of rotating a sheet substantially 90°, an image-forming apparatus, and an image-reading apparatus.

According to one aspect of the present invention, a sheet feeder includes first and second rollers configured to apply a feeding force to a sheet; a first driven gear configured to transmit a rotational driving force to the first roller; a second driven gear configured to transmit the rotational driving force to the second roller; a first drive gear configured to transmit the rotational driving force to the first driven gear; a second drive gear configured to transmit the rotational driving force to the second driven gear; a third drive gear configured to transmit the rotational driving force to the first driven gear; a first drive unit switchable between a meshing state, in which the first drive unit simultaneously meshes with the first drive gear and the second drive gear, and an escape state, in which the first drive unit does not mesh with the first drive gear or the second drive gear; a second drive unit switchable between the meshing state, in which the second drive unit simultaneously meshes with the second drive gear and the third drive gear, and the escape state, in which the second drive unit does not mesh with the second drive gear or the third drive gear; a power source inputting the rotational driving force to the first drive unit and the second drive unit; and a control unit configured to switch the first drive unit to the meshing state and the second drive unit to the escape state so as to input the rotational driving force from the power source to the first drive unit and to switch the first drive unit to the escape state and the second drive unit to the meshing state so as to input the rotational driving force from the power source to the second drive unit.

According to the above embodiment of the present invention, the first and second rollers and the power source therefor can be used not only to feed the sheet in a direction parallel to the surface thereof (in a direction tangent to the surface thereof if the sheet is curved), but also to rotate the sheet about an axis parallel to a direction normal to the surface thereof.

The present invention can thus provide a simple, compact sheet feeder capable of rotating a sheet substantially 90° without using an additional mechanism or power source for rotating the sheet and can also provide an image-forming apparatus and an image-reading apparatus.

Further features of the present invention will become apparent from the following description of exemplary embodiments with reference to the attached drawings.

BRIEF DESCRIPTION OF THE DRAWINGS

FIG. 5 is a table showing the states of the first and second input gears, the rotational direction of a power source (motor), and the resulting operational modes of the roller section (first and second rollers) in the first embodiment.

FIG. 8A illustrates a state where a power source rotates counterclockwise in the drawings. FIG. 8B illustrates a state where the power source rotates clockwise in the drawings.

FIG. 9A illustrates a state where the power source rotates counterclockwise in the drawings. FIG. 9B illustrates a state where the power source rotates clockwise in the drawings.

FIG. 10 is a table showing the states of first and second input gears, the rotational direction of the power source (motor), and the resulting operational modes of a roller section (first and second rollers) in the second embodiment.

FIG. 12A illustrates a state where a power source rotates counterclockwise in the drawings. FIG. 12B illustrates a state where the power source rotates clockwise in the drawings.

FIG. 13 is a table showing the states of first and second input gears, the rotational direction of the power source (motor), and the resulting operational modes of a roller section (first and second rollers) in the third embodiment.

DESCRIPTION OF THE EMBODIMENTS

Figure 1:
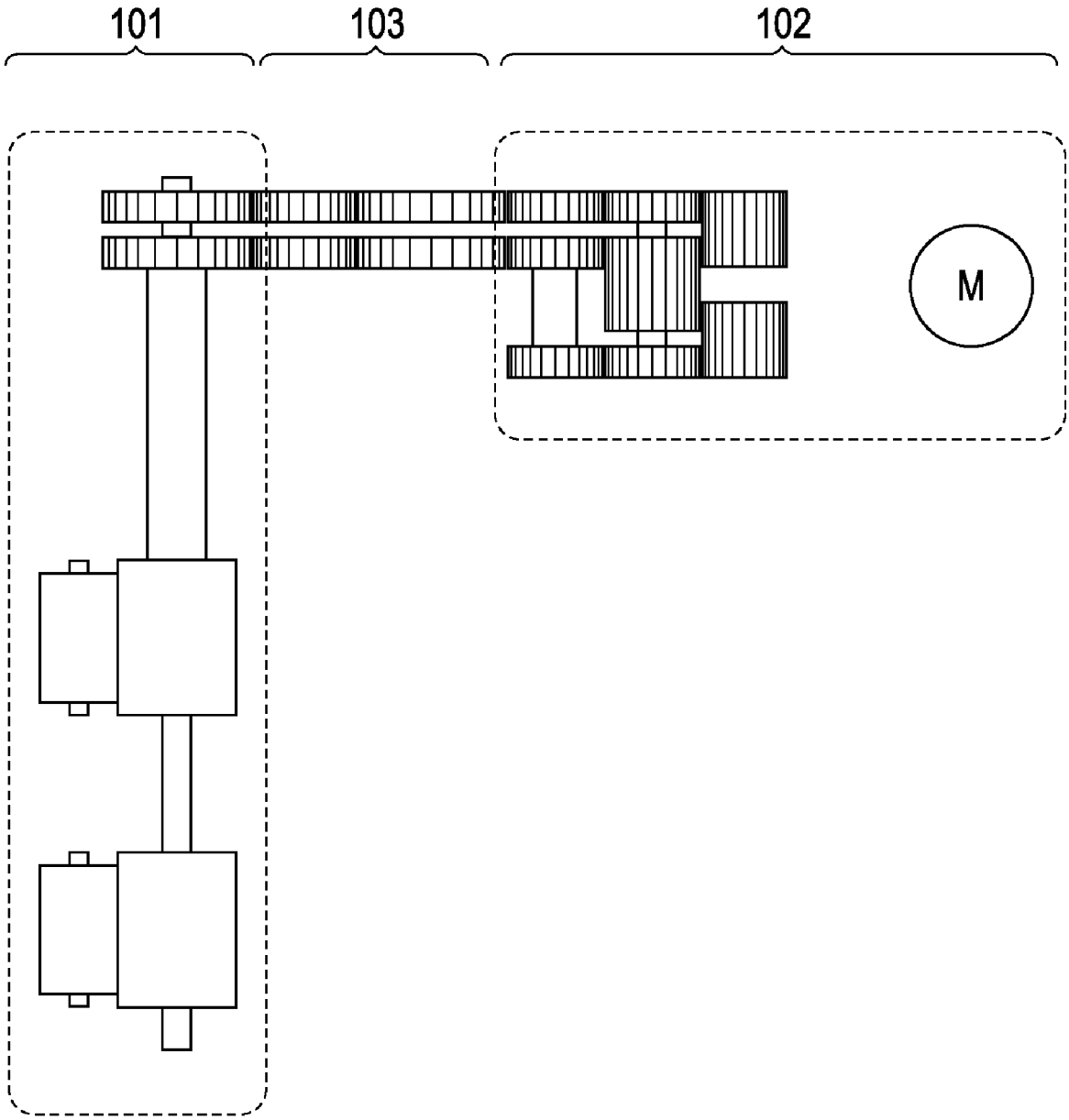
FIG. 1 is a schematic plan view of a sheet feeder according to a first embodiment of the present invention.

Embodiments of the present invention will now be specifically described with reference to the drawings, wherein the same reference numerals indicate the same or corresponding portions throughout the drawings. FIG. 1 is a schematic plan view of a sheet feeder according to a first embodiment of the present invention. In FIG. 1, the sheet feeder includes a roller section 101, a drive section 102, and a drive transmission section 103 including, for example, idler gears. The sheet feeder transmits a rotational driving force from the drive section 102 to the roller section 101 via the drive transmission section 103 to rotate rollers provided in the roller section 101, thereby feeding a sheet. The roller section 101, the drive section 102, and the drive transmission section 103 are sequentially described in detail below.

Figure 2A:
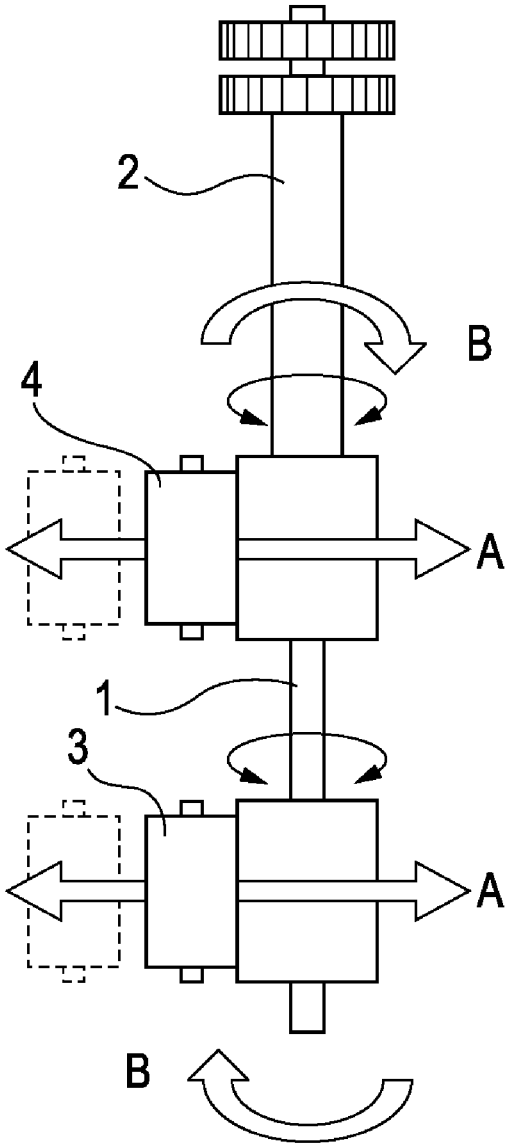
FIGS. 2A and 2B are a plan view and a sectional view, respectively, of a roller section of the sheet feeder according to the first embodiment.
Figure 2B:
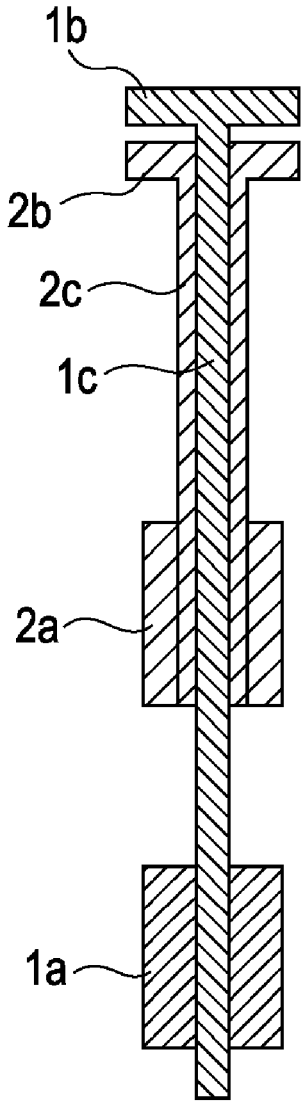

FIGS. 2A and 2B are a plan view and a sectional view, respectively, of the roller section 101 of the sheet feeder according to the first embodiment. In FIGS. 2A and 2B, a first roller 1 includes a first roller member 1*a*, a first gear 1*b* disposed at an end of the first roller 1, and a shaft 1*c* coaxially holding the first roller member 1*a* and the first gear 1*b*. The first roller 1 is supported rotatably about the central axis thereof (indicated by the one-dot chain line in the drawings). A second roller 2 includes a second roller member 2*a*, a second gear 2*b* disposed at an end of the second roller 2, and a pipe 2*c* coaxially holding the second roller member 2*a* and the second gear 2*b*. The second roller 2 is supported rotatably about the central axis thereof (indicated by the one-dot chain line in the drawings).

The first roller 1 and the second roller 2 can be rotated about the same central axis either in the same direction or in opposite directions by changing the directions of rotation input to the first gear 1*b* and the second gear 2*b*. A driven roller 3 is rotatably supported opposite the first roller member 1*a* of the first roller 1. Another driven roller 4 is rotatably supported opposite the second roller member 2*a* of the second roller 2. A sheet can be fed in the direction indicated by arrows A in FIG. 2A by rotating the first roller 1 and the second roller 2 in the same direction with the sheet being pressed and held between the two rollers 1 and 2 and the corresponding driven rollers 3 and 4. In this state, the sheet can also be rotated in the direction indicated by arrows B by rotating the first roller 1 and the second roller 2 in opposite directions.

Figure 3A:
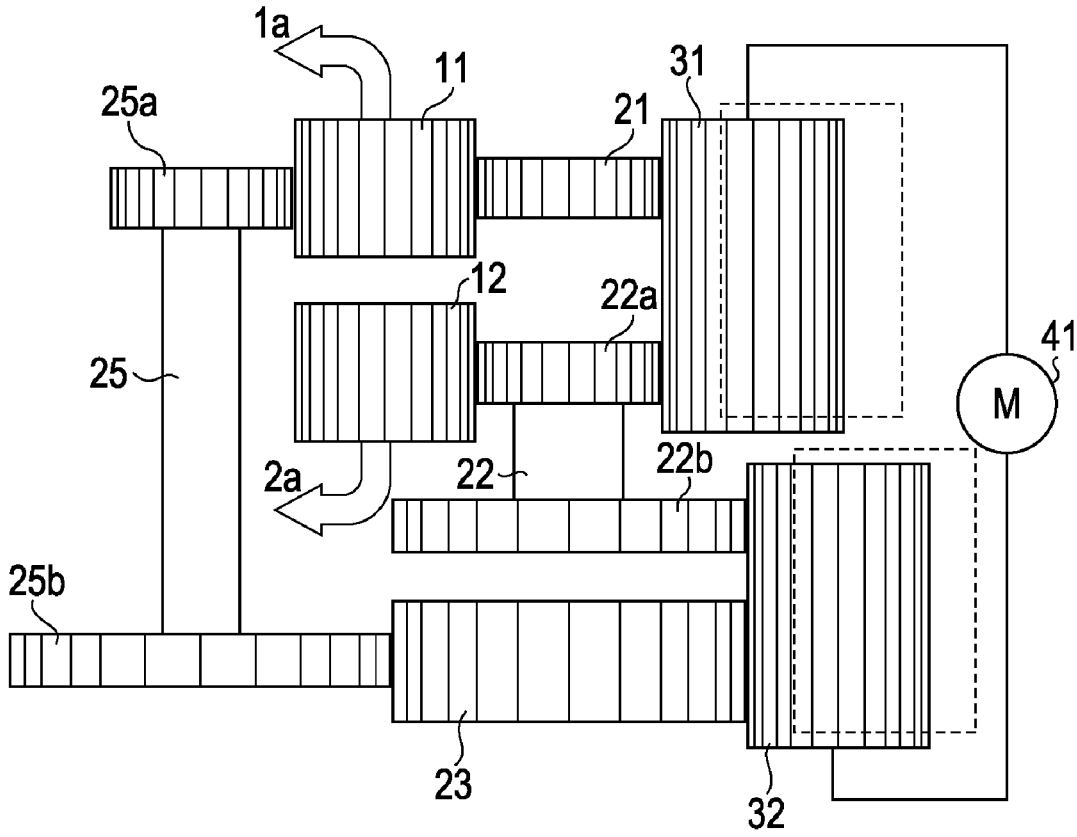
FIGS. 3A and 3B are a plan view and a side view, respectively, of a drive section and a drive transmission section of the sheet feeder according to the first embodiment.
Figure 3B:
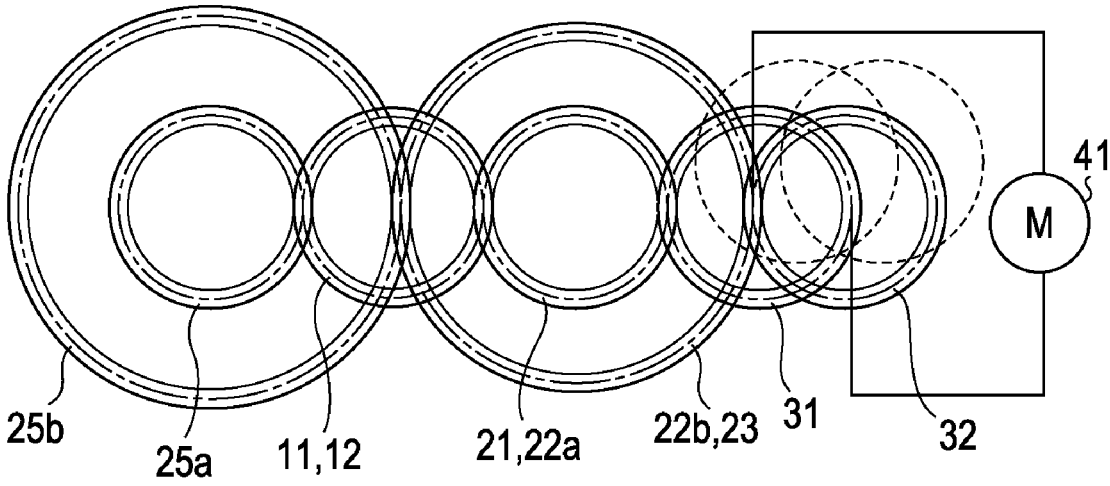

FIGS. 3A and 3B are a plan view and a side view, respectively, of the drive section 102 and the drive transmission section 103 of the sheet feeder according to the first embodiment. In FIG. 3B, gears are illustrated according to the drawing method of Japanese Industrial Standards (JIS); the solid lines indicate addendum circles, the one-dot chain lines indicate pitch circles, and the thin lines indicate root circles. In FIGS. 3A and 3B, a first driven gear 11 can transmit a rotational driving force to the first roller member 1*a* of the first roller 1 via the gear 1*b* thereof, and a second driven gear 12 can transmit a rotational driving force to the second roller member 2*a* of the second roller 2 via the gear 2*b* thereof. These driven gears 11 and 12 are separate gears that are supported rotatably about the same axis and can also be rotated in different directions.

A first drive gear 21 meshes with the first driven gear 11. A second drive gear 22 meshes with the second driven gear 12 and has two gear portions 22*a* and 22*b*. A transmission gear 25 meshes with the first driven gear 11 and has two gear portions 25*a* and 25*b*. A third drive gear 23 meshes with the transmission gear 25 (the gear portion 25*b* thereof). The first drive gear 21, the second drive gear 22, and the third drive gear 23 are separate gears that are supported rotatably about the same axis and can also be rotated in different directions.

A first input gear 31 constitutes a first drive unit and can simultaneously mesh with the first drive gear 21 and the second drive gear 22. A second input gear 32 constitutes a second drive unit and can simultaneously mesh with the second drive gear 22 and the third drive gear 23. A motor 41 is a power source for rotating the first drive unit 31 and the second drive unit 32. The power source has only one motor 41.

Figure 15:
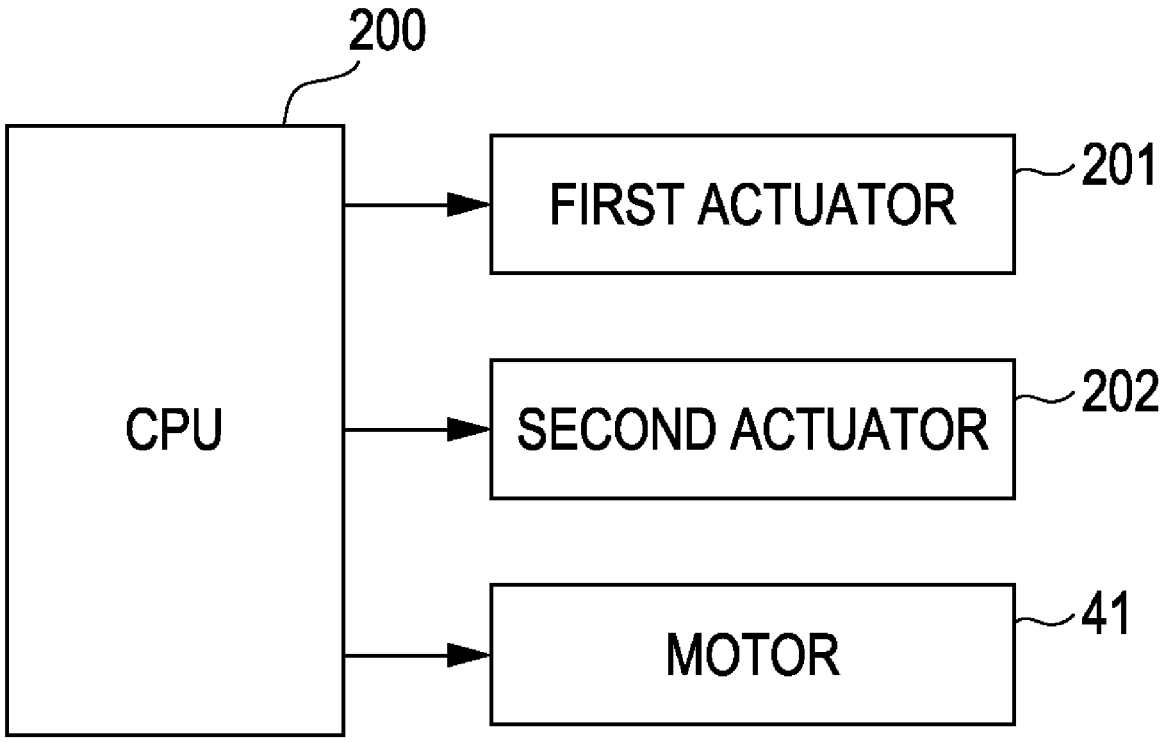
FIG. 15 is a block diagram of a control system used in the sheet feeders according to the embodiments of the present invention.

FIG. 15 is a block diagram of a control system. This system includes a CPU (control unit) 200, a first actuator 201 for actuating the first input gear 31, and a second actuator 202 for actuating the second input gear 32. The actuators 201 and 202 each include, for example, a link for supporting the input gears 31 and 32 and a solenoid for actuating the link.

The CPU 200 can drive the first actuator 201 to switch the first input gear 31 to a meshing state (indicated by the solid lines in the drawings) or to an escape state (indicated by the dotted lines in the drawings). In the meshing state, the first input gear 31 can simultaneously mesh with the first drive gear 21 and the second drive gear 22. In the escape state, the first input gear 31 does not mesh with the first drive gear 21 or the second drive gear 22. The CPU 200 can also drive the second actuator 202 to switch the second input gear 32 to the meshing state or to the escape state. In the meshing state, the second input gear 32 can simultaneously mesh with the second drive gear 22 and the third drive gear 23. In the escape state, the second input gear 32 does not mesh with the second drive gear 22 or the third drive gear 23.

Figure 4A:
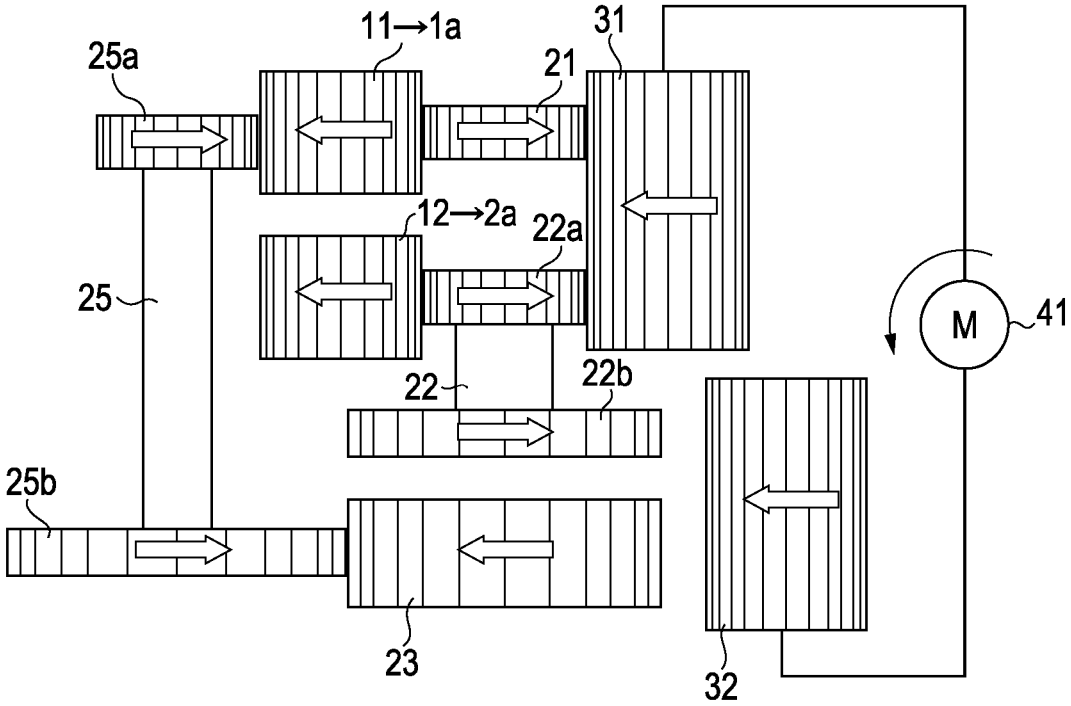
FIG. 4A is a plan view of the drive section and the drive transmission section in FIGS. 3A and 3B, illustrating a state where a first input gear meshes with a first drive gear and a second drive gear.
Figure 4B:
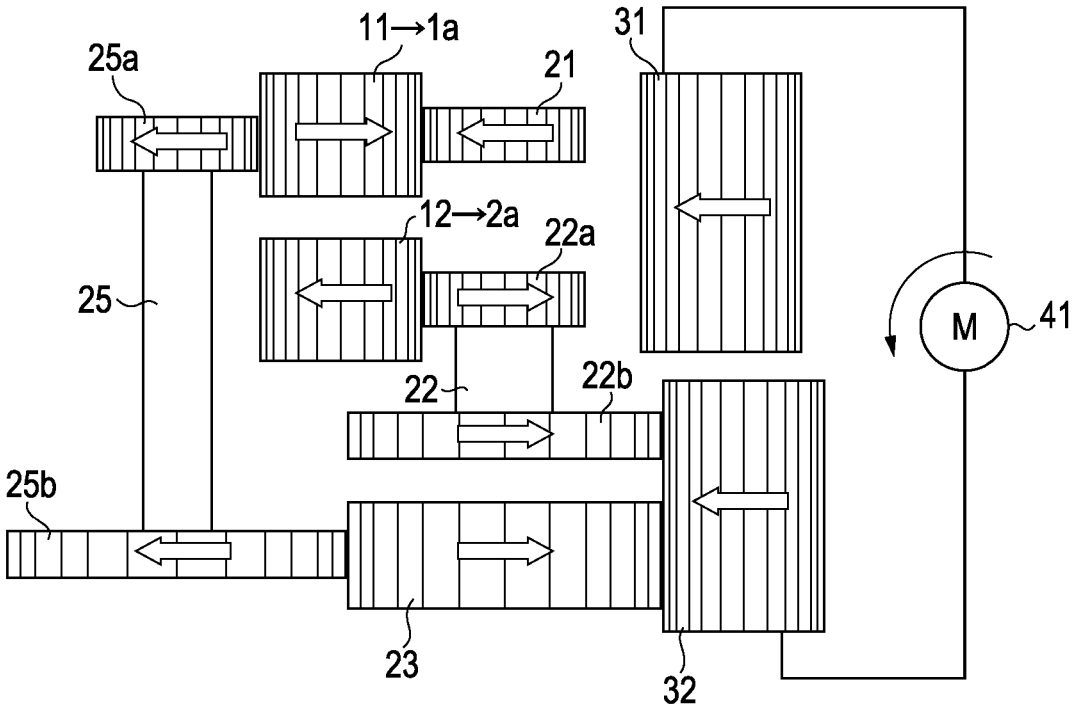
FIG. 4B is another plan view of the drive section and the drive transmission section in FIGS. 3A and 3B, illustrating a state where a second input gear meshes with the second drive gear and a third drive gear.

FIG. 4A illustrates a state where the first input gear 31 meshes with the first drive gear 21 and the second drive gear 22. FIG. 4B illustrates a state where the second input gear 32 meshes with the second drive gear 22 and the third drive gear 23. In FIG. 4A, the CPU 200 switches the first input gear 31 to the meshing state, where the first input gear 31 simultaneously meshes with the first drive gear 21 and the second drive gear 22, and also switches the second input gear 32 to the escape state, where the second input gear 32 does not mesh with the second drive gear 22 or the third drive gear 23. The arrows shown in FIG. 4A indicate the directions in which the individual gears are rotated in the states described above as the motor 41 rotates in the illustrated direction.

In FIG. 4B, the CPU 200 switches the second input gear 32 to the meshing state, where the second input gear 32 simultaneously meshes with the second drive gear 22 and the third drive gear 23, and also switches the first input gear 31 to the escape state, where the first input gear 31 does not mesh with the first drive gear 21 or the second drive gear 22. The arrows shown in FIG. 4B indicate the directions in which the individual gears are rotated in the states described above as the motor 41 rotates in the illustrated direction. The motor 41, the first input gear 31, and the second input gear 32 rotate in the same direction in FIGS. 4A and 4B. The first driven gear 11 and the second driven gear 12 rotate in the same direction in FIG. 4A and in opposite directions in FIG. 4B. Hence, the first driven gear 11 and the second driven gear 12 rotate the first roller 1 and the second roller 2, respectively, in the same direction in FIG. 4A and in opposite directions in FIG. 4B.

In FIG. 4A, the rotational direction of the first roller member 1*a* and the second roller member 2*a* can also be reversed by rotating the motor 41 in the direction opposite the illustrated direction. The first driven gear 11 and the second driven gear 12 transmit rotational driving forces to the first roller 1 and the second roller 2, respectively, via the drive transmission section 103. Hence, the driven gears 11 and 12 can rotate the rollers 1 and 2, respectively, in the same direction in the state of FIG. 4A and in opposite directions in the state of FIG. 4B. The first roller 1 and the second roller 2 can each be rotated in either direction.

FIG. 5 is a table showing the states of the first drive unit (first input gear) 31 and the second drive unit (second input gear) 32, the rotational direction of the power source (motor) 41, and the resulting operational modes of the roller section 101 (the first roller 1 and the second roller 2) in the first embodiment. FIG. 5 shows how the rotational directions of the rollers 1 and 2 are changed according to combinations of the states of the input gears 31 and 32 (the meshing state or the escape state) and the rotational direction of the motor 41. The rotational directions shown in FIG. 5 are mere examples, and the rotational directions of the individual gears and rollers can be reversed, depending on the number of intermediate transmission gears used. In any case, the four combinations shown in FIG. 5 can be achieved.

According to this embodiment, as shown in FIG. 5, the roller section 101 can be driven in the state of FIG. 4A to perform normal sheet feeding in two directions, that is, to feed a sheet in two directions parallel to the surface thereof. The roller section 101 can also be driven in the state of FIG. 4B to rotate the sheet about an axis parallel to a direction normal to the surface thereof. The sheet feeder can thus perform normal feeding operation and rotating operation using the same feed rollers, rather than using an additional sheet-rotating mechanism or power source. The sheet feeder can therefore achieve a simpler, more compact structure which contributes to cost reduction.

In the exemplary structure of this embodiment, no transmission gear is disposed between the first driven gear 11 and the first drive gear 21 or between the second driven gear 12 and the second drive gear 22, and one transmission gear (the transmission gear 25) is disposed between the first driven gear 11 and the third drive gear 23. The number of transmission gears disposed between the first driven gear 11 and the first drive gear 21, the number of transmission gears disposed between the second driven gear 12 and the second drive gear 22, and the number of transmission gears disposed between the first driven gear 11 and the third drive gear 23 are referred to as A, B, and C, respectively. The operations described above can be achieved if not all of A, B, and C are even numbers or odd numbers, that is, if only one of A, B, and C is an even number with the other two being odd numbers or if only one of A, B, and C is an odd number with the other two being even numbers. This embodiment, in which A, B, and C are 0, 0, and 1, respectively, applies to the case where only one of A, B, and C is an odd number with the other two being even numbers (wherein zero is assumed to be an even number).

Figure 6:
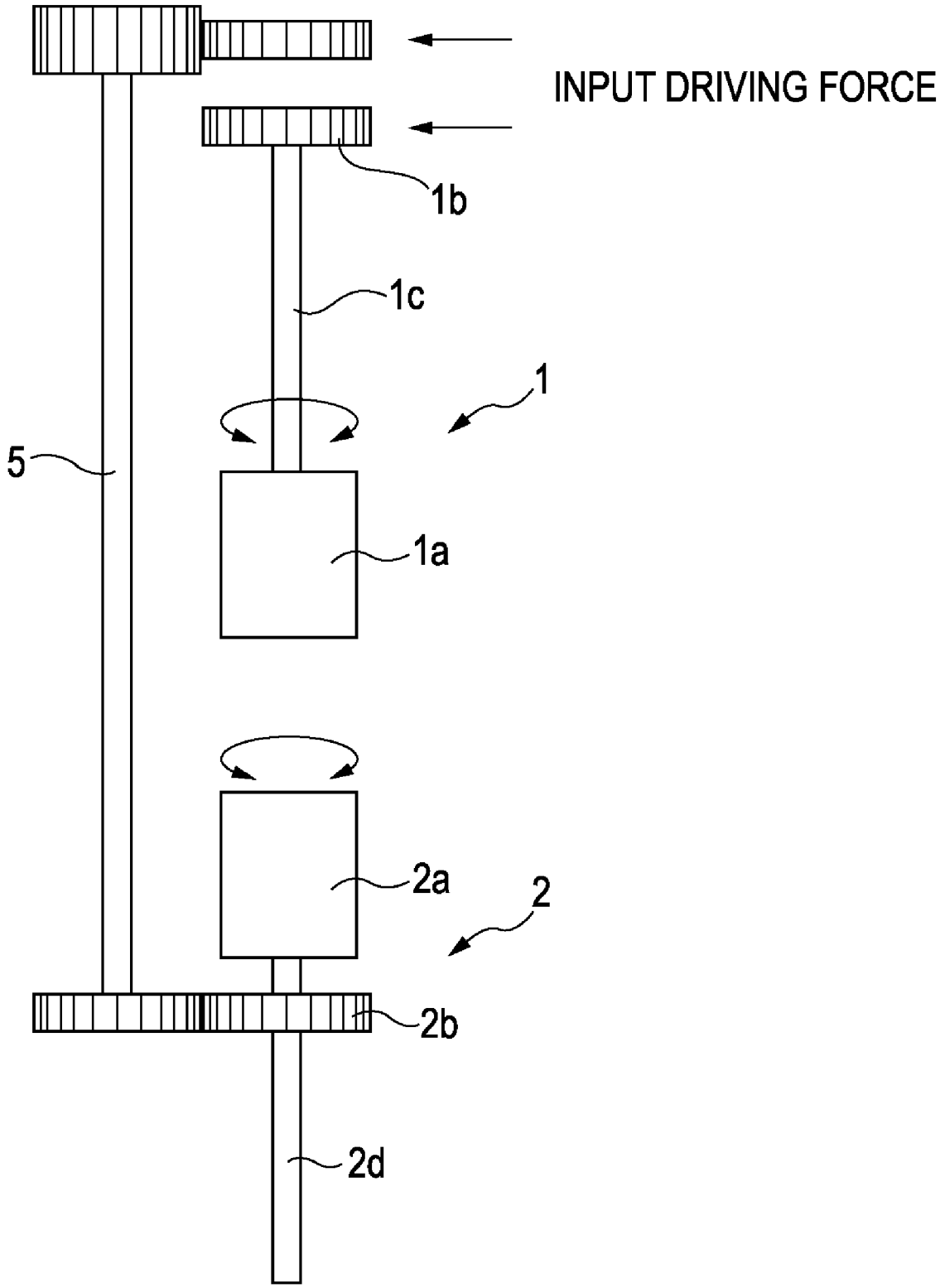
FIG. 6 is a plan view of another example of the roller section of the sheet feeder according to the first embodiment.

FIG. 6 is a plan view of another example of the roller section 101 of the sheet feeder according to this embodiment. The first roller 1 and the second roller 2 are coaxially arranged in the example of FIGS. 1 to 5, although they may also be noncoaxially arranged in proximity to achieve the same advantages. In the example of FIGS. 1 to 5, additionally, the second roller 2 supports the first roller 1 with the shaft 1*c* thereof accommodated in the pipe 2*c*. As shown in FIG. 6, the pipe 2*c* may be replaced with a shaft 2*d*, and an idler gear 5 may be used to transmit a rotational driving force. The structure shown in FIG. 6 can provide substantially the same advantages.

In this embodiment, transmission gears are disposed between the gear 1*b* of the first roller 1 and the first driven gear 11 and between the gear 2*b* of the second roller 2 and the second driven gear 12. The first driven gear 11 and the second driven gear 12 may be allowed to mesh directly with the gear 1*b* of the first roller 1 and the gear 2*b* of the second roller 2, respectively. Alternatively, the first driven gear 11 and the second driven gear 12 may be the same as the gear 1*b* of the first roller 1 and the gear 2*b* of the second roller 2, respectively. Such modifications can provide the same advantages.

For rotational drive transmission mechanisms using gears as in this embodiment, delays in mechanical response due to backlash can occur in gear trains from a power source to first and second rollers. These delays can result in a slight difference in starting time between the first and second rollers when the power source starts rotating the first and second rollers from rest. If the start of the rotation of either roller is delayed because of a large difference in starting time between the first and second rollers, a sheet such as recording paper can be fed in a direction inclined with respect to the feed direction. Such inclined feeding can impair the parallelism of the sheet with respect to the feed direction.

Although the numbers of teeth of the individual gears are not particularly specified in this embodiment, gears having the same number of teeth and the same module may be used for the gear 1*b* of the first roller 1 and the gear 2*b* of the second roller 2, for the first drive gear 21 and the second drive gear 22, and for the second drive gear 22 and the third drive gear 23. As a result, the drive systems of the two rollers 1 and 2 can be made to have substantially equal delays in mechanical response due to backlash, rather than eliminating the delays themselves. Using gears having the same number of teeth and the same module thus allows the first roller 1 and the second roller 2 to be substantially simultaneously rotated after the power source 41 is started. The sheet feeder can therefore achieve a highly accurate sheet-feeding mechanism that does not impair the parallelism of the sheet with respect to the feed direction.

Figure 7A:
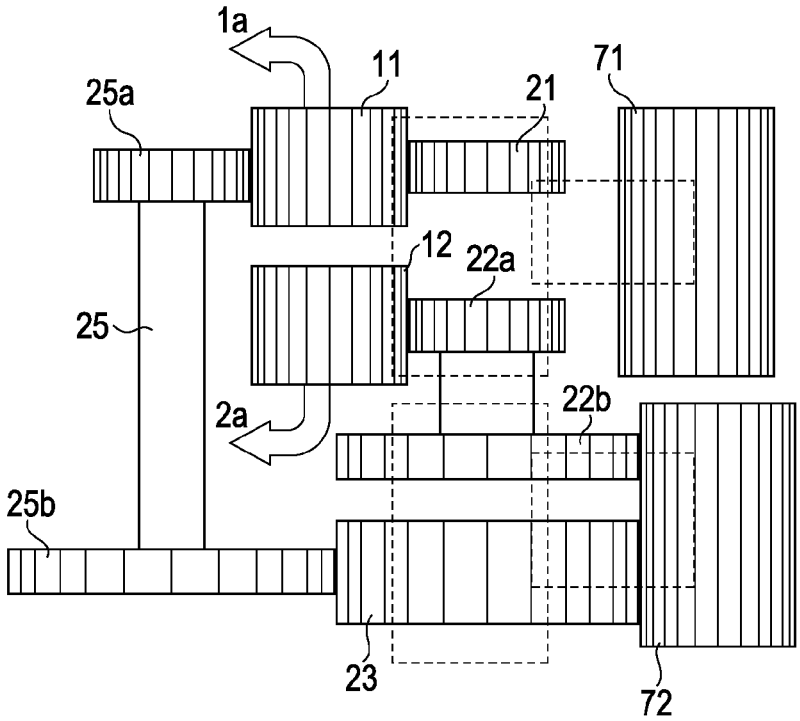
FIGS. 7A and 7B are a plan view and a side view, respectively, of a drive section and a drive transmission section of a sheet feeder according to a second embodiment of the present invention.
Figure 7B:
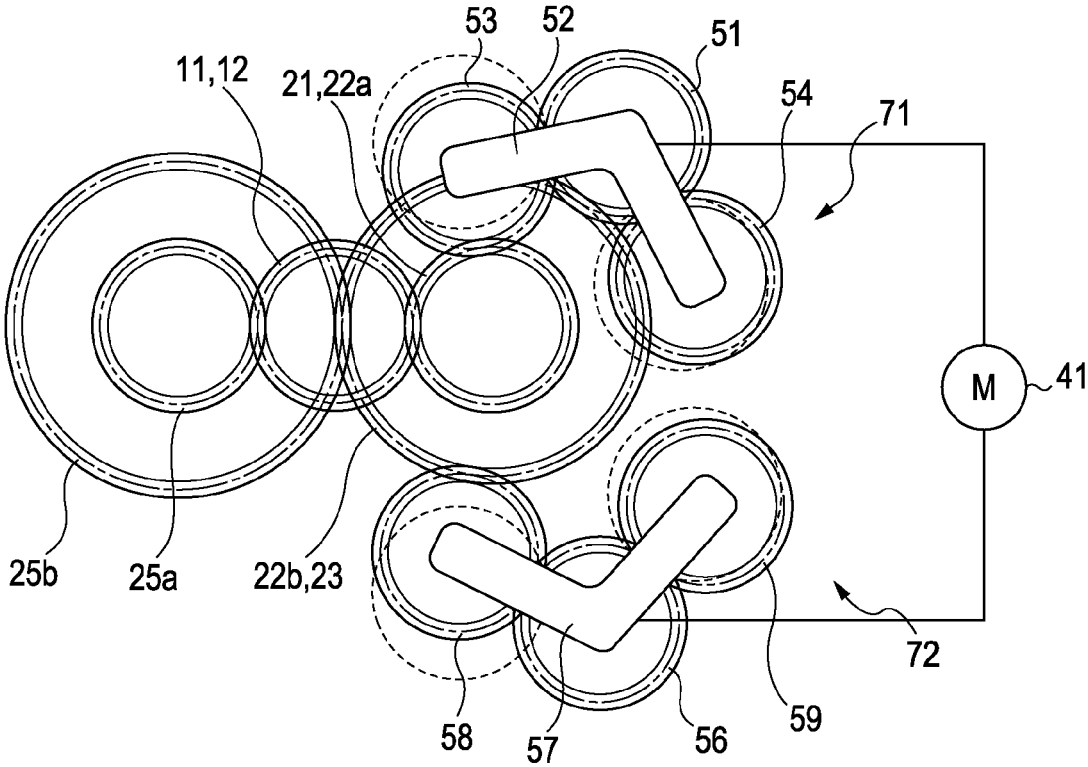

FIGS. 7A and 7B are a plan view and a side view, respectively, of a drive section 102 and a drive transmission section 103 of a sheet feeder according to a second embodiment of the present invention. In this embodiment, the same reference numerals as in the first embodiment (FIGS. 1 to 6) indicate the same or corresponding portions. In FIGS. 7A and 7B, the sheet feeder according to this embodiment includes a first drive unit 71 and a second drive unit 72 instead of the first input gear (first drive unit) 31 and the second input gear (second drive unit) 32, respectively, in the first embodiment.

The first drive unit 71 includes a central gear 51 that can be rotated by a rotational driving force input from a rotational power source (motor) 41, a lever 52 that can be swung about the central gear 51, and gears 53 and 54 rotatably supported at the ends of the lever 52. The second drive unit 72 includes a central gear 56 that can be rotated by the rotational driving force input from the rotational power source 41, a lever 57 that can be swung about the central gear 56, and gears 58 and 59 rotatably supported at the ends of the lever 57. The gears 53 and 54 disposed on the lever 52 can simultaneously mesh with the first drive gear 21 and the second drive gear 22 (the gear portion 22*a*). The gears 58 and 59 disposed on the lever 57 can simultaneously mesh with the second drive gear 22 (the gear portion 22*b*) and the third drive gear 23.

The CPU 200 can drive the first actuator 201 to switch the first drive unit 71 to a swingable state where the lever 52 can be swung or to a restrained state where the lever 52 is restrained. In the swingable state, the gears 53 and 54 are set to a meshing state (indicated by the solid lines in the drawings) where they can mesh with the first drive gear 21 and the second drive gear 22 (the gear portion 22*a*). In the restrained state, the gears 53 and 54 are set to an escape state (indicated by the dotted lines in the drawings) where they cannot mesh with the first drive gear 21 or the gear portion 22*a* of the second drive gear 22.

Similarly, the CPU 200 can also drive the second actuator 202 to switch the second drive unit 72 to a swingable state where the lever 57 can be swung or to a restrained state where the lever 57 is restrained. In the swingable state, the gears 58 and 59 are set to a meshing state (indicated by the solid lines in the drawings) where they can mesh with the second drive gear 22 (the gear portion 22*b*) and the third drive gear 23. In the restrained state, the gears 58 and 59 are set to an escape state (indicated by the dotted lines in the drawings) where they cannot mesh with the second drive gear 22 or the third drive gear 23. The sheet feeder according to the second embodiment in FIGS. 7A and 7B has substantially the same structure as the sheet feeder according to the first embodiment except for the features described above.

Figure 8A:
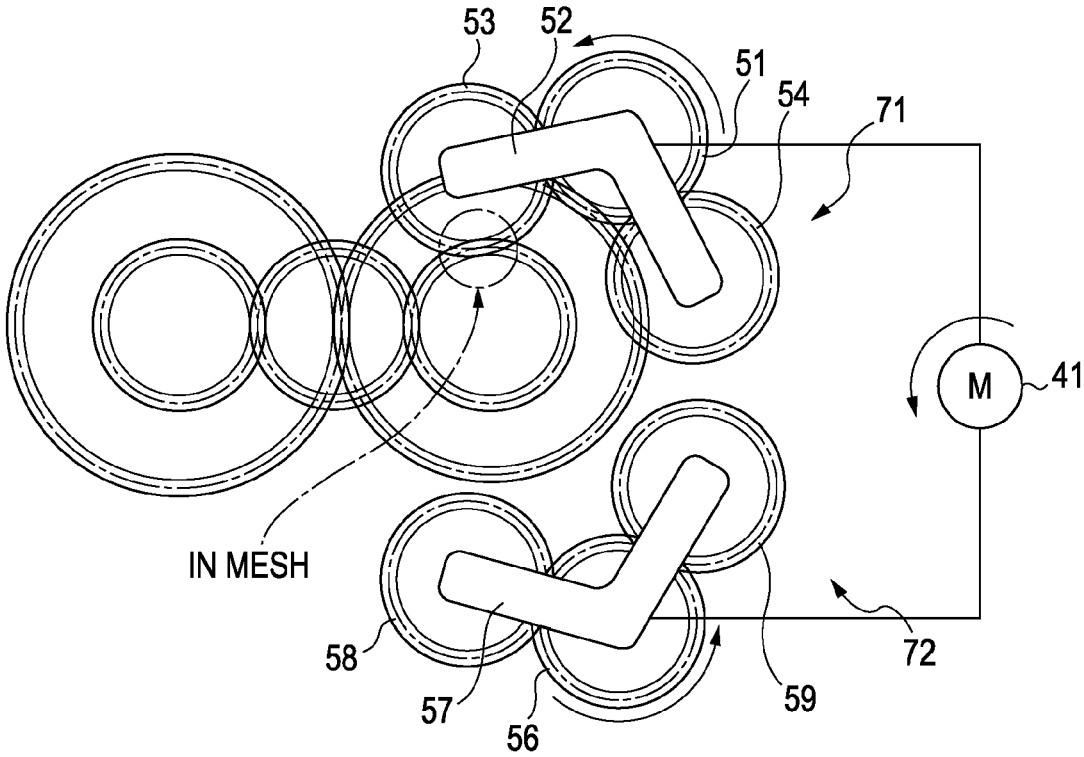
FIGS. 8A and 8B are side views of the drive section and the drive transmission section in FIGS. 7A and 7B with a first drive unit set to the meshing state and a second drive unit set to the escape state.
Figure 8B:
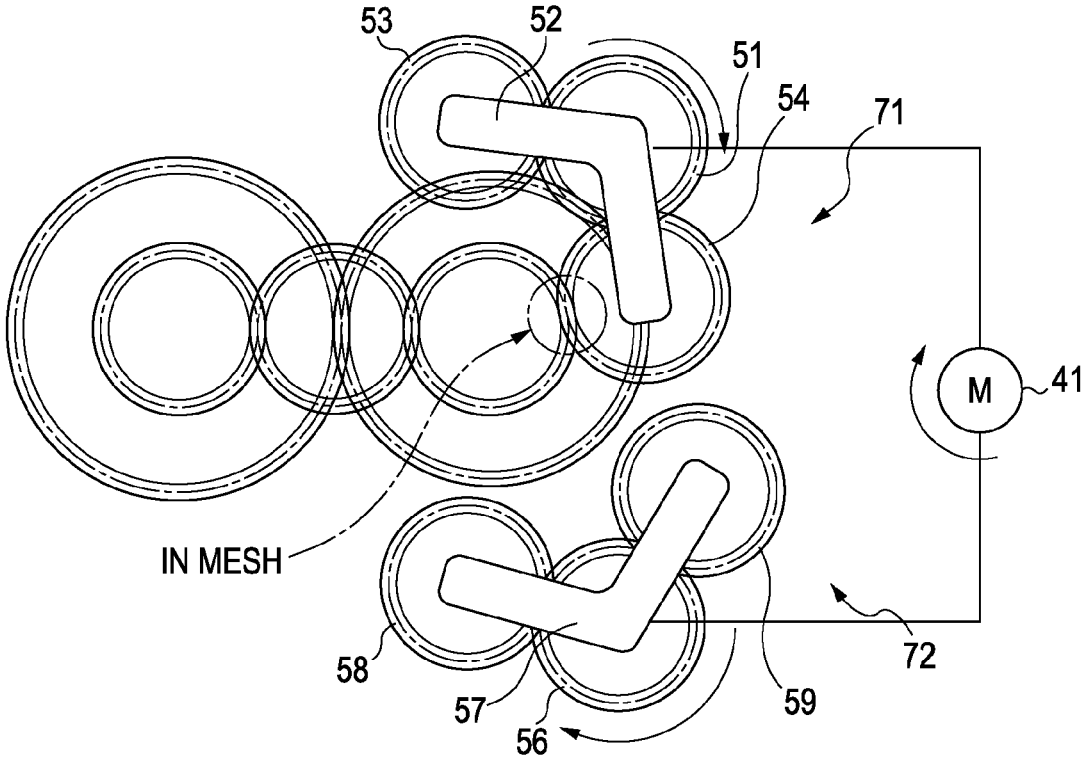

FIGS. 8A and 8B are side views of the drive section 102 and the drive transmission section 103 in FIGS. 7A and 7B. In FIGS. 8A and 8B, the first drive unit 71 is set to the meshing state while the second drive unit 72 is set to the escape state. The power source 41 rotates counterclockwise in FIG. 8A and rotates clockwise in FIG. 8B. In FIG. 8A, the central gear 51 rotates counterclockwise so that the gear 53 disposed on the lever 52 meshes with the first drive gear 21 and the gear portion 22*a* of the second drive gear 22, and the gear 54 is separated therefrom. In FIG. 8B, the central gear 51 rotates clockwise so that the gear 54 disposed on the lever 52 meshes with the first drive gear 21 and the gear portion 22*a* of the second drive gear 22, and the gear 53 is separated therefrom.

Figure 9A:
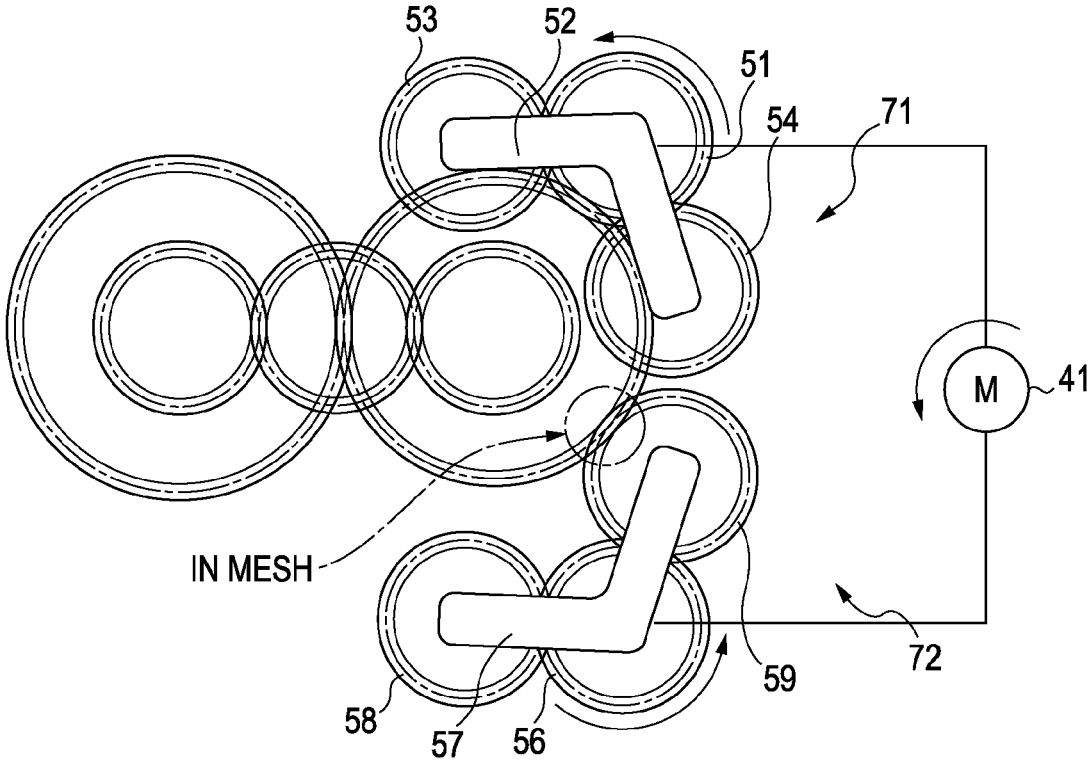
FIGS. 9A and 9B are side views of the drive section and the drive transmission section in FIGS. 7A and 7B with the first drive unit set to the escape state and the second drive unit set to the meshing state.
Figure 9B:
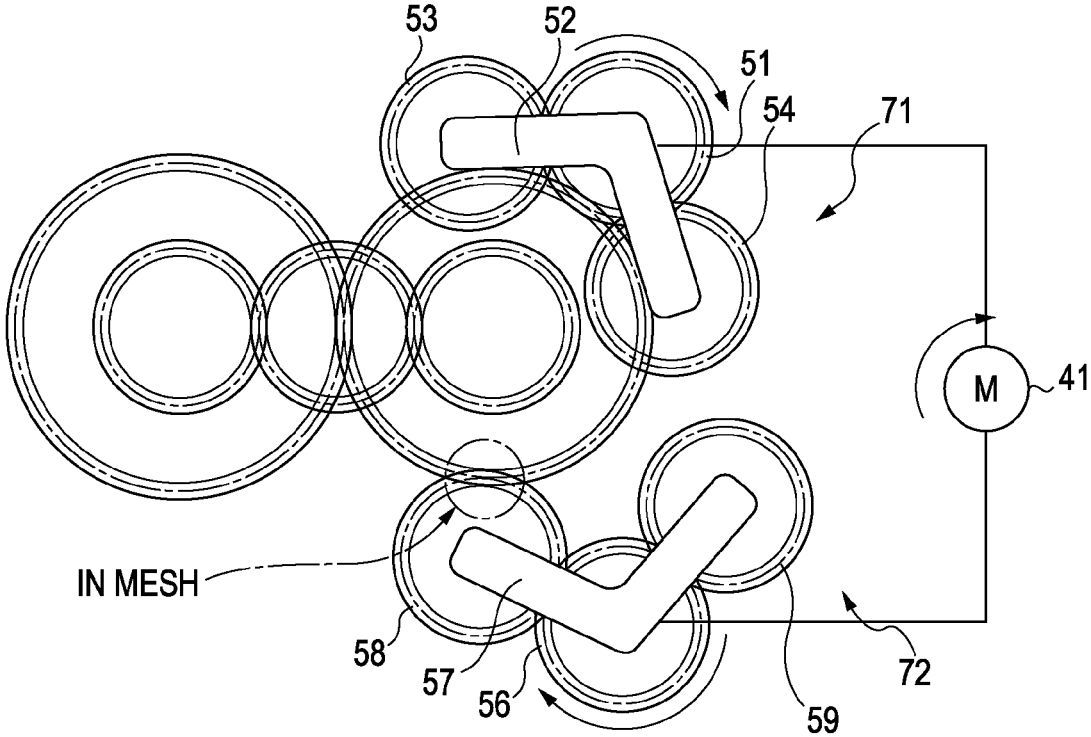

FIGS. 9A and 9B are side views of the drive section 102 and the drive transmission section 103 in FIGS. 7A and 7B. In FIGS. 9A and 9B, the first drive unit 71 is set to the escape state while the second drive unit 72 is set to the meshing state. The power source 41 rotates counterclockwise in FIG. 9A and rotates clockwise in FIG. 9B. In FIG. 9A, the central gear 56 rotates counterclockwise so that the gear 59 disposed on the lever 57 meshes with the gear portion 22*b* of the second drive gear 22 and the third drive gear 23, and the gear 58 is separated therefrom. In FIG. 9B, the central gear 56 rotates clockwise so that the gear 58 disposed on the lever 57 meshes with the gear portion 22*b* of the second drive gear 22 and the third drive gear 23, and the gear 59 is separated therefrom.

The sheet feeder according to this embodiment has substantially the same structure as the sheet feeder according to the first embodiment described with reference to FIGS. 1 to 6 except that the first drive unit 71 and the second drive unit 72 are used instead of the first input gear 31 and the second input gear 32, respectively.

FIG. 10 is a table showing the states of the first drive unit 71 and the second drive unit 72, the rotational direction of the power source (motor) 41, and the resulting operational modes of the roller section 101 (the first roller 1 and the second roller 2). FIG. 10 shows how the rotational directions of the rollers 1 and 2 are changed by switching the first drive unit 71 and the second drive unit 72 to the meshing state or the escape state. The rotational directions shown in FIG. 10 are mere examples, and the rotational directions of the individual gears and rollers can be reversed, depending on the number of intermediate transmission gears used. In any case, the four combinations shown in FIG. 10 can be achieved.

According to this embodiment, as shown in FIG. 10, the roller section 101 can be driven in the state of FIGS. 8A and 8B to perform normal sheet feeding in two directions, that is, to feed a sheet in two directions parallel to the surface thereof. The roller section 101 can also be driven in the state of FIGS. 9A and 9B to rotate the sheet about an axis parallel to a direction normal to the surface thereof. The sheet feeder including the first drive unit 71 and the second drive unit 72 according to the second embodiment can thus provide the same operations and advantages as in the first embodiment. That is, the sheet feeder can perform normal feeding operation and rotating operation using the same feed rollers, rather than using an additional sheet-rotating mechanism or power source. The sheet feeder can therefore achieve a simpler, more compact structure which contributes to cost reduction.

In the exemplary structure of this embodiment, no transmission gear is disposed between the first driven gear 11 and the first drive gear 21 or between the second driven gear 12 and the second drive gear 22, and one transmission gear (the transmission gear 25) is disposed between the first driven gear 11 and the third drive gear 23. The number of transmission gears disposed between the first driven gear 11 and the first drive gear 21, the number of transmission gears disposed between the second driven gear 12 and the second drive gear 22, and the number of transmission gears disposed between the first driven gear 11 and the third drive gear 23 are referred to as A, B, and C, respectively. As in the first embodiment, the operations described above can be achieved if not all of A, B, and C are even numbers or odd numbers, that is, if only one of A, B, and C is an even number with the other two being odd numbers or if only one of A, B, and C is an odd number with the other two being even numbers.

The numbers of teeth of the individual gears are not particularly specified in this embodiment. As in the first embodiment, higher sheet feeding accuracy can be achieved if gears having the same number of teeth and the same module are used for the gear 1*b* of the first roller 1 and the gear 2*b* of the second roller 2, for the first drive gear 21 and the second drive gear 22, and for the second drive gear 22 and the third drive gear 23.

Figure 11A:
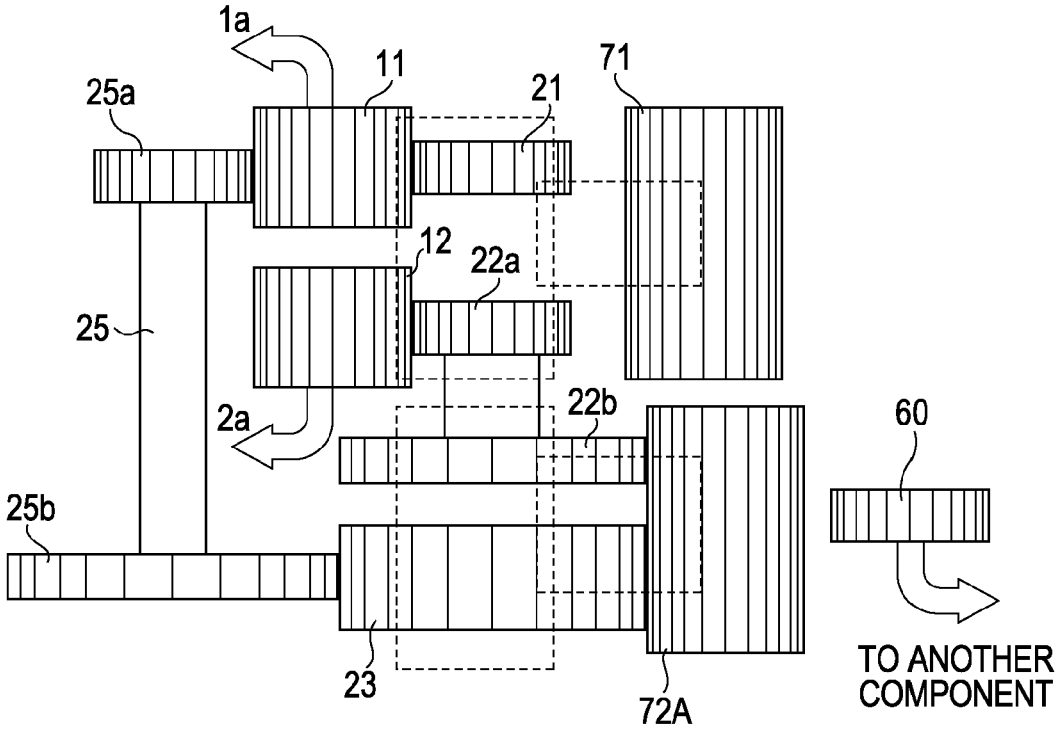
FIGS. 11A and 11B are a plan view and a side view, respectively, of a drive section and a drive transmission section of a sheet feeder according to a third embodiment of the present invention.
Figure 11B:
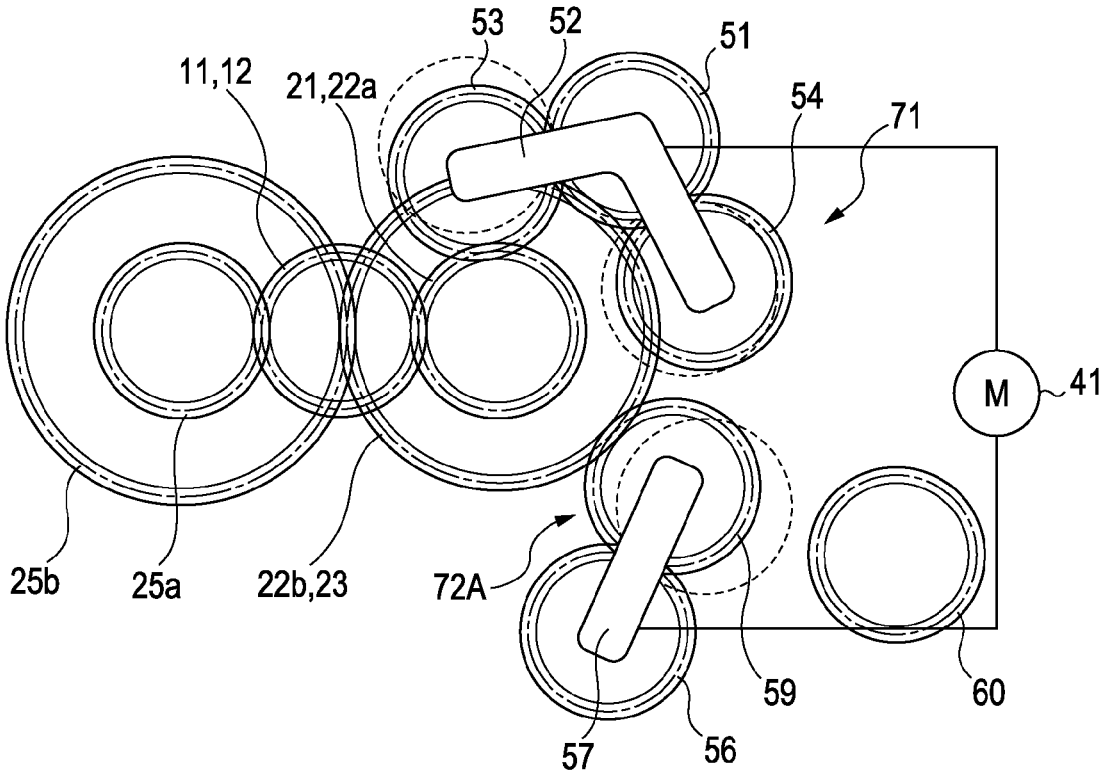

FIGS. 11A and 11B are a plan view and a side view, respectively, of a drive section 102 and a drive transmission section 103 of a sheet feeder according to a third embodiment of the present invention. In this embodiment, the same reference numerals as in the first embodiment (FIGS. 1 to 6) and the second embodiment (FIGS. 7A and 7B to 10) indicate the same or corresponding portions. In FIGS. 11A and 11B, the sheet feeder according to this embodiment includes a first drive unit 71, a second drive unit 72A, and a gear 60 that can transmit a rotational driving force to another component to be rotated (not shown), such as a feed roller. In this embodiment, the first drive unit 71 is used instead of the first input gear (first drive unit) 31, and the second drive unit 72A and the gear 60 are used instead of the second input gear (second drive unit) 32.

The first drive unit 71 includes a central gear 51 that can be rotated by a rotational driving force input from a rotational power source (motor) 41, a lever 52 that can be swung about the central gear 51, and gears 53 and 54 rotatably supported at the ends of the lever 52. The second drive unit 72A includes a central gear 56 that can be rotated by the rotational driving force input from the rotational power source 41, a lever 57 that can be swung about the central gear 56, and a gear 59 rotatably supported by the lever 57. The gears 53 and 54 disposed on the lever 52 can simultaneously mesh with the first drive gear 21 and the second drive gear 22 (the gear portion 22*a*). The gear 59 disposed on the lever 57 can simultaneously mesh with the second drive gear 22 (the gear portion 22*b*) and the third drive gear 23. The gear 59 can also mesh with the gear 60 to transmit the rotational driving force to the component to be rotated.

The CPU 200 can drive the first actuator 201 to switch the first drive unit 71 to a swingable state where the lever 52 can be swung or to a restrained state where the lever 52 is restrained. In the swingable state, the gears 53 and 54 are set to a meshing state (indicated by the solid lines in the drawings) where they can mesh with the first drive gear 21 and the second drive gear 22 (the gear portion 22*a*). In the restrained state, the gears 53 and 54 are set to an escape state (indicated by the dotted lines in the drawings) where they cannot mesh with the first drive gear 21 or the gear portion 22*a* of the second drive gear 22. The first drive unit 71 in this embodiment has the same structure and operation as that in the second embodiment.

Figure 12A:
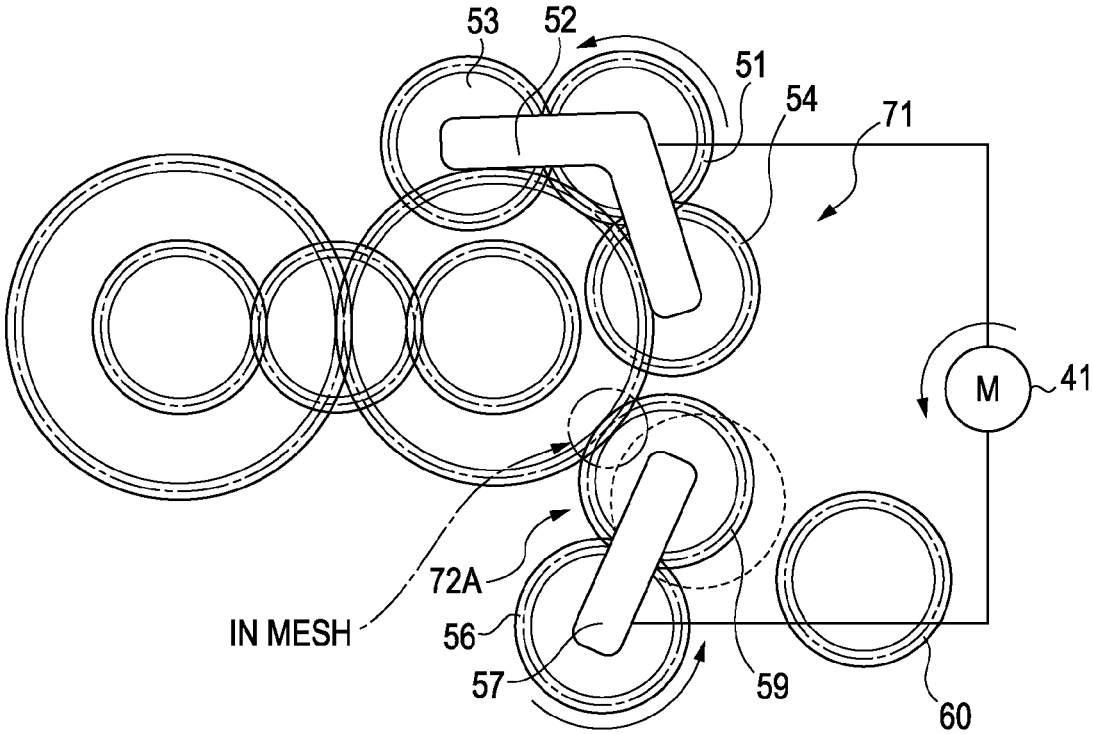
FIGS. 12A and 12B are side views of the drive section and the drive transmission section in FIGS. 11A and 11B with a first drive unit set to the escape state and a second drive unit set to the meshing state.
Figure 12B:
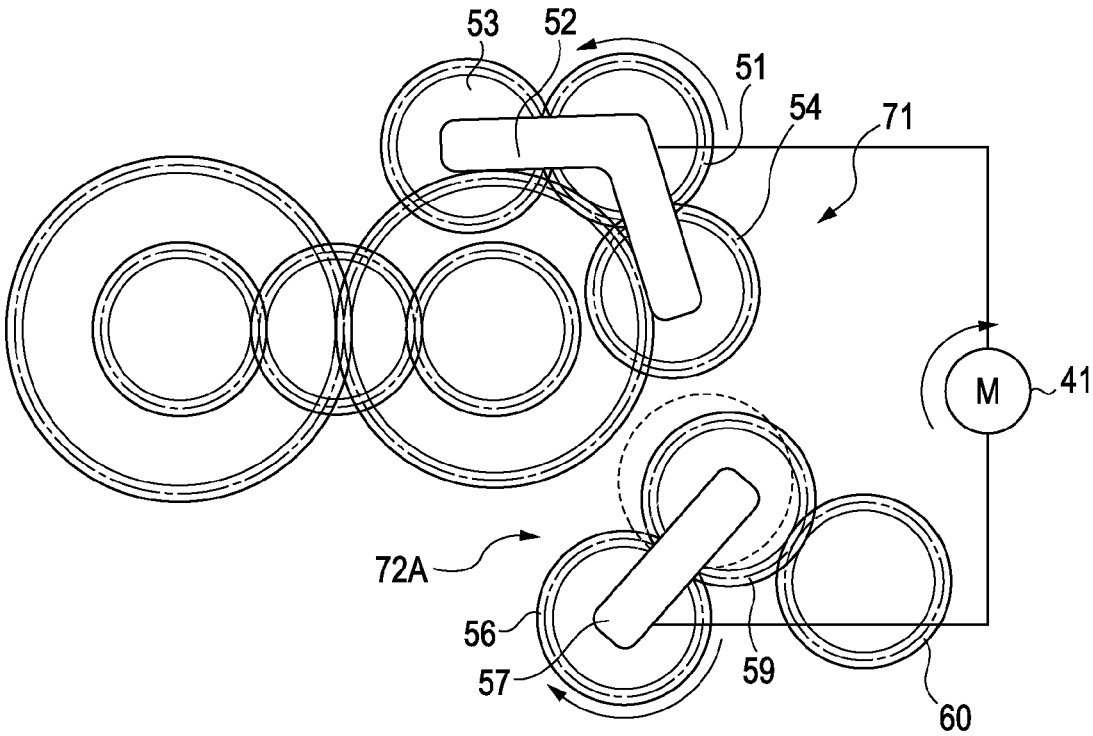

FIGS. 12A and 12B are side views of the drive section 102 and the drive transmission section 103 in FIGS. 11A and 11B. In FIGS. 12A and 12B, the second drive unit 72A is set to the swingable state. The power source 41 rotates counterclockwise in FIG. 12A and rotates clockwise in FIG. 12B. In FIGS. 11A, 11B, 12A, and 12B, the CPU 200 can drive the second actuator 202 to switch the second drive unit 72A to the swingable state or to the restrained state. In the swingable state, the gear 59 is set to a meshing state (indicated by the solid lines in the drawings) where it can mesh with the second drive gear 22 (the gear portion 22*b*) and the third drive gear 23 or the gear 60. In the restrained state, the gear 59 is set to an escape state (indicated by the dotted lines in the drawings) where it cannot mesh with the second drive gear 22 (the gear portion 22*b*), the third drive gear 23, or the gear 60. In the swingable state, the gear 59 meshes with the gear portion 22*b* of the second drive gear 22 and the third drive gear 23 when the power source 41 rotates counterclockwise, as shown in FIG. 12A, and meshes with the gear 60 when the power source 41 rotates clockwise, as shown in FIG. 12B.

The sheet feeder according to this embodiment has substantially the same structure as the sheet feeder according to the first embodiment described with reference to FIGS. 1 to 6 except that the first drive unit 71 is used instead of the first input gear 31, as in the second embodiment, and the second drive unit 72A and the gear 60 are used instead of the second input gear 32.

FIG. 13 is a table showing the states of the first drive unit 71 and the second drive unit 72A, the rotational direction of the power source (motor) 41, and the resulting operational modes of the roller section 101 (the first roller 1 and the second roller 2). FIG. 13 shows how the rotational directions of the rollers 1 and 2 are changed by switching the first drive unit 71 and the second drive unit 72A to the meshing state or the escape state. The rotational directions shown in FIG. 13 are mere examples, and the rotational directions of the individual gears and rollers can be reversed, depending on the number of intermediate transmission gears used. In any case, the four combinations shown in FIG. 13 can be achieved.

According to this embodiment, as shown in FIG. 13, the roller section 101 can be driven with the first drive unit 71 set to the state of FIGS. 8A and 8B in the second embodiment to perform normal sheet feeding in two directions, that is, to feed a sheet in two directions parallel to the surface thereof. The roller section 101 can also be driven with the second drive unit 72A set to the state of FIG. 12A to rotate the sheet about an axis parallel to a direction normal to the surface thereof.

While a sheet can be rotated in two directions in the first and second embodiments, a sheet can be rotated only in one direction in the third embodiment. Instead, the second drive unit 72A can be used to rotate the gear 60 and thus rotate any mechanism of interest, such as a feed roller, via the gear 60 in this embodiment. The sheet feeder according to this embodiment can therefore achieve a simpler structure for driving another mechanism. That is, as in the embodiments described above, the sheet feeder according to the third embodiment can perform normal feeding operation and rotating operation using the same feed rollers, rather than using an additional sheet-rotating mechanism or power source. The sheet feeder can therefore achieve a simpler, more compact structure which contributes to cost reduction.

In the exemplary structure of this embodiment, no transmission gear is disposed between the first driven gear 11 and the first drive gear 21 or between the second driven gear 12 and the second drive gear 22, and one transmission gear (the transmission gear 25) is disposed between the first driven gear 11 and the third drive gear 23. The number of transmission gears disposed between the first driven gear 11 and the first drive gear 21, the number of transmission gears disposed between the second driven gear 12 and the second drive gear 22, and the number of transmission gears disposed between the first driven gear 11 and the third drive gear 23 are referred to as A, B, and C, respectively. As in the first and second embodiments, the operations described above can be achieved if not all of A, B, and C are even numbers or odd numbers, that is, if only one of A, B, and C is an even number with the other two being odd numbers or if only one of A, B, and C is an odd number with the other two being even numbers.

The numbers of teeth of the individual gears are not particularly specified in this embodiment. As in the first and second embodiments, higher sheet feeding accuracy can be achieved if gears having the same number of teeth and the same module are used for the gear 1*b* of the first roller 1 and the gear 2*b* of the second roller 2, for the first drive gear 21 and the second drive gear 22, and for the second drive gear 22 and the third drive gear 23.

The sheet feeders described above can be applied to image-forming apparatuses (recording apparatuses) for forming an image on a sheet using an image-forming unit (recording head) according to predetermined information (recording information) and image-reading apparatuses for reading an image from a sheet (document) using an image-reading unit. The operations and advantages described above can also be achieved in such applications.

Figure 14A:
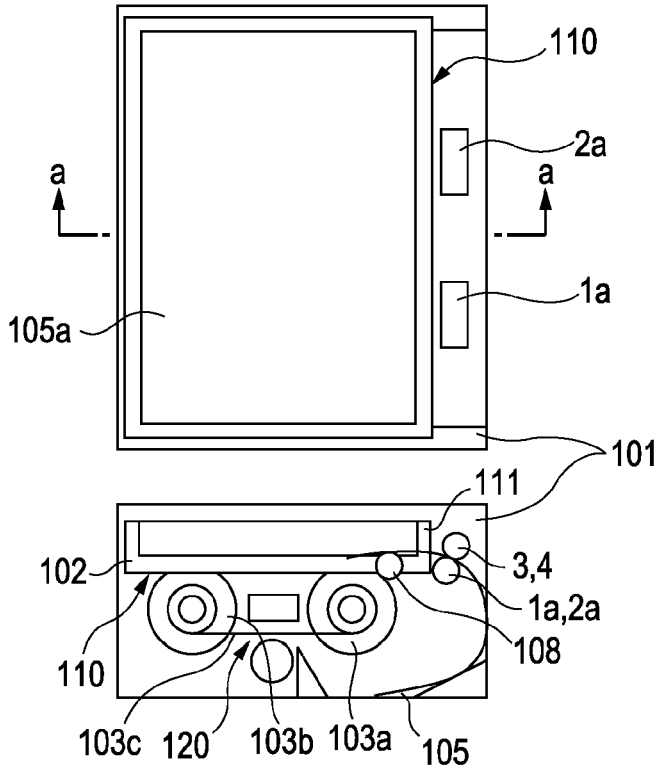
FIGS. 14A, 14B, and 14C are diagrams of a recording apparatus according to the present invention.
Figure 14B:
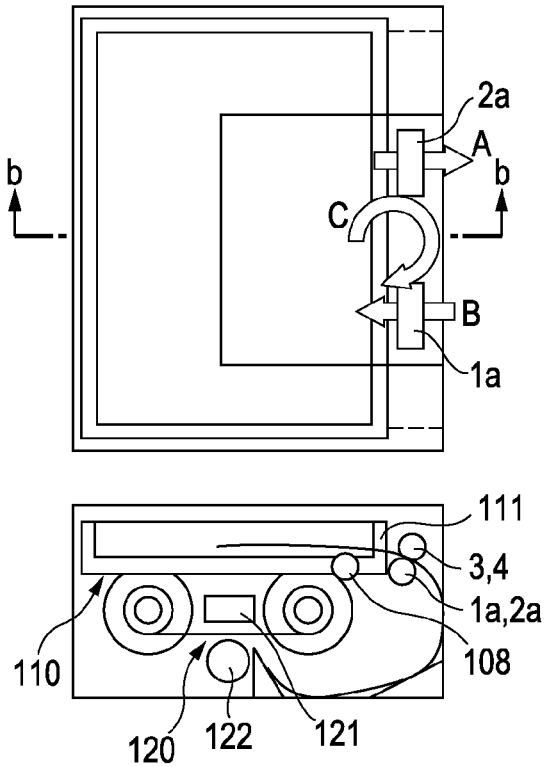
Figure 14C:
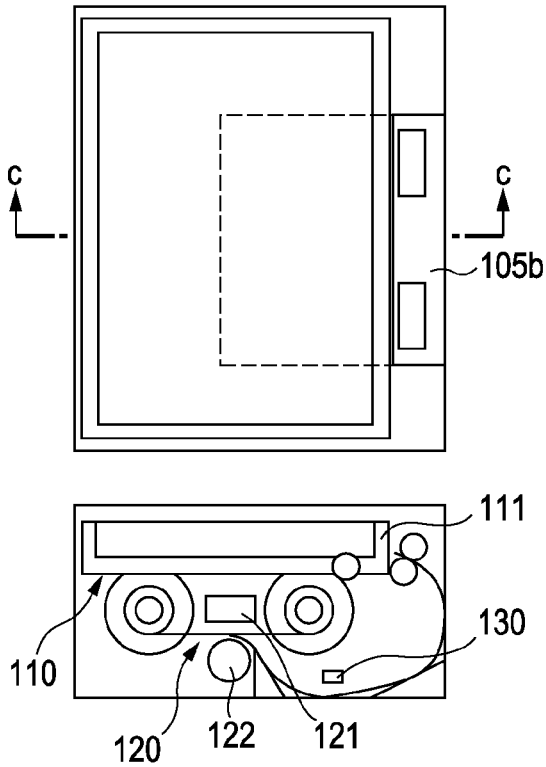

FIGS. 14A to 14C illustrate an example of a recording apparatus including a sheet feeder according to the present invention.

The recording apparatus in FIGS. 14A to 14C is a heat-transfer recording apparatus for recording an image by heating an ink sheet to transfer ink onto a recording sheet. The recording apparatus includes a detachable integral cartridge 110 including a recording sheet holder 102 and an ink sheet holder 103. The recording sheet holder 102 includes a cassette that holds recording sheets 105 so that they can be drawn out one by one. The ink sheet holder 103 includes a first take-up roller 103*a* and a second take-up roller 103*b* (first and second bobbins) that are rotatably supported inside a frame of the cartridge 110. The ends of an elongated ink sheet (ink ribbon) 103*c* are fixed to the two take-up rollers 103*a* and 103*b*. The ink sheet 103*c* can be drawn out (unwound) along the surface of the recording sheet 105 by rotating one of the take-up rollers 103*a* and 103*b*. That is, the ink sheet 103*c* is wound around the first bobbin 103*a* in advance and is transferred to the second bobbin 103*b* by rotating the second bobbin 103*b*.

The recording apparatus has an image-forming section 120 including a thermal line head (recording head) 121 and a platen roller 122 to press the drawn recording sheet 105 and the ink sheet 103*c* therebetween. The line head 121 has heat-generating elements arranged substantially linearly along the width of the recording sheet 105. The heat-generating elements are driven in synchronization with the sheet feeding of the platen roller 122 to fuse and transfer ink from the ink sheet 103*c* to the recording sheet 105, thereby performing image recording.

FIG. 14A includes a plan view of the recording apparatus and a sectional view taken along line a-a, illustrating the removal and feeding of the recording sheet 105 from the cartridge 110. FIG. 14B includes a plan view of the recording apparatus and a sectional view taken along line b-b, illustrating the rotation of the recording sheet 105 being fed. FIG. 14C includes a plan view of the recording apparatus and a sectional view taken along line c-c, illustrating the feeding of the rotated recording sheet 105 to the image-forming section 120.

In FIGS. 14A to 14C, in this embodiment, the recording sheet holder 102 has a sheet outlet 111 and a feed unit including a feed roller 108 in the vicinity thereof. The feed unit has a separating lug that can separate the recording sheets 105 one by one. The feed roller 108 is disposed below the recording sheets 105 to separately feed (eject) the bottommost recording sheet 105.

The first roller member 1*a* and the second roller member 2*a* are disposed outside the sheet outlet 111 of the recording sheet holder 102 at two positions separated by a predetermined distance in the width direction. The driven rollers 3 and 4 are adjacent to the first roller member 1*a* and the second roller member 2*a*, respectively. The roller members 1*a* and 2*a* can be rotated in the same direction to feed the recording sheet 105 forward or backward. The roller members 1*a* and 2*a* can also be rotated in opposite directions to rotate the recording sheet 105 about an axis parallel to a direction normal to a recording surface thereof. The roller members 1*a* and 2*a* can thus serve as a rotating unit.

The first roller member 1*a* and the second roller member 2*a* can serve as a sheet-rotating unit to rotate the recording sheet 105 substantially 90° about the axis parallel to the direction normal to the recording surface when the recording sheet 105 is fed from the cartridge 110 to the image-forming section 120. The longitudinal direction of the recording sheets 105 held in the recording sheet holder 102 is substantially perpendicular to that of the recording sheet 105 passing through the image-forming section 120 during recording. The two pairs of rollers are arranged in the width direction for feeding operation and rotating operation in this embodiment, although three or more pairs of rollers may be arranged and used separately for feeding operation and rotating operation.

Next, the recording operation of the recording apparatus will be described below with reference to FIGS. 14A to 14C.

The recording sheet 105 is fed in the order of the states illustrated in FIGS. 14A to 14C. FIG. 14A illustrates the state where the recording sheet 105 is drawn (ejected) out of the recording sheet holder 102. FIG. 14B illustrates the state where the recording sheet 105 is rotated. FIG. 14C illustrates the state where the rotated recording sheet 105 is fed to an image-forming position (print position). The process of feeding the recording sheet 105 from the recording sheet holder 102 to the image-forming section 120 is described in detail below.

FIG. 14A illustrates the removal and feeding of the recording sheet 105 from the recording sheet holder 102 as a first step of the image-forming process of the recording apparatus. The roller members 1*a* and 2*a* and the driven rollers 3 and 4 are not in contact with the recording sheet 105 before the sheet 105 is drawn out. The roller members 1*a* and 2*a* may then be either in or out of contact with the driven rollers 3 and 4, respectively. The top of the recording sheets 105 held in the recording sheet holder 102 is pressed downward by any mechanism (not shown) to facilitate the feeding of the recording sheets 105 by the feed roller 108. The feed roller 108 separates and feeds the bottommost recording sheet 105 from the recording sheet holder 102 into the nips between the roller members 1*a* and 2*a* and the driven rollers 3 and 4, respectively, through the sheet outlet 111 of the cartridge 110. The roller members 1*a* and 2*a* may then be separated from the driven rollers 3 and 4, respectively, to reduce the resistance to the entry of the leading end of the recording sheet 105 into the nips therebetween.

The recording sheet 105 is held between the first roller member 1*a* and the driven roller 3 and between the second roller member 2*a* and the driven roller 4. The roller members 1*a* and 2*a* and the driven rollers 3 and 4 are rotated in the same direction to draw out the recording sheet 105 to a position shown in FIG. 14B. In FIG. 14B, the recording sheet 105 is rotated with part thereof being left inside the recording sheet holder 102 by rotating the first roller member 1*a* and the second roller member 2*a* in opposite directions.

The first roller member 1*a* and the second roller member 2*a* are rotated in opposite directions to rotate the recording sheet 105 substantially 90° in the direction indicated by arrow C. During the rotating operation, the feed roller 108 may be separated from the recording sheet 105 to eliminate the pressure on the recording sheet 105 inside the recording sheet holder 102.

Slits or guides may be disposed at, for example, sidewalls or components of the cartridge 110 to prevent such portions from interfering with the rotation of the recording sheet 105. The interference in rotation may also be prevented by appropriately setting or adjusting the amount of feed from the position where the removal and feeding of the recording sheet 105 is started to the position where the rotating operation is started, that is, the amount by which the recording sheet 105 is drawn out.

After the recording sheet 105 is rotated substantially 90°, the first roller member 1*a* and the second roller member 2*a* are rotated in the same direction to feed the recording sheet 105 to the image-forming position, as shown in FIG. 14C. In this embodiment, the recording sheet 105 is fed to the image-forming section 120, which is positioned below the cartridge 110. The recording sheet 105 is held between the first roller member 1*a* and the driven roller 3 and between the second roller member 2*a* and the driven roller 4 and is fed to the image-forming section 120 by rotating the roller members 1*a* and 2*a* in the same direction. The image-forming section 120 then presses the recording sheet 105 between the recording head 121 and the platen roller 122 together with the ink sheet 103*c* fed from the ink sheet holder 103. While the two sheets 105 and 103*c* are being fed by the rotation of the platen roller 122, the recording head 121 is driven to heat and transfer ink onto the recording sheet 105 to form an image thereon.

As shown in FIG. 14C, an image-reading unit 130 may be provided to read an image from a document fed from the recording sheet holder 102 by the feed roller 108 and rotated by the roller members 1*a* and 2*a*.

The present invention is not limited to printers, and may also be applied to other recording apparatuses (image-forming apparatuses), including copiers, printing machines, fax machines, and multifunction devices and systems having such functions. In addition, the present invention may be applied to image-reading apparatuses such as scanners and multifunction devices and systems having a scanner function. Furthermore, recording apparatuses according to the present invention may be based on any type of recording, such as inkjet recording, laser beam recording, heat-transfer recording, thermal recording, and wire-dot recording.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-229554 filed Aug. 8, 2005, which is hereby incorporated by reference herein in its entirety.

What is claimed is:

1. A sheet feeder comprising:

first and second rollers configured to apply a feeding force to a sheet;

a first driven gear configured to transmit a rotational driving force to the first roller;

a second driven gear configured to transmit the rotational driving force to the second roller;

a first drive gear configured to transmit the rotational driving force to the first driven gear;

a second drive gear configured to transmit the rotational driving force to the second driven gear;

a third drive gear configured to transmit the rotational driving force to the first driven gear;

a first drive unit switchable between a meshing state, in which the first drive unit simultaneously meshes with the first drive gear and the second drive gear, and an escape state, in which the first drive unit does not mesh with the first drive gear or the second drive gear;

a second drive unit switchable between the meshing state, in which the second drive unit simultaneously meshes with the second drive gear and the third drive gear, and the escape state, in which the second drive unit does not mesh with the second drive gear or the third drive gear;

a power source inputting the rotational driving force to the first drive unit and the second drive unit; and a control unit configured to switch the first drive unit to the meshing state and the second drive unit to the escape state so as to input the rotational driving force from the first drive unit to the first drive gear and the second drive gear and to switch the first drive unit to the escape state and the second drive unit to the meshing state so as to input the rotational driving force from the second drive unit to the second drive gear and the third drive gear, wherein the rotational driving force is input from the power source to the first drive unit so as to rotate the first and second rollers in the same direction or is input from the power source to the second drive unit so as to rotate the first and second rollers in opposite directions, and wherein when the first and second rollers rotate in the same direction, the sheet is conveyed in a direction, and when the first and second rollers rotate in opposite directions, the sheet is turned about an axis parallel to a direction normal to the surface thereof.

2. The sheet feeder according to claim 1, wherein a number of transmission gears disposed between the first driven gear and the first drive gear, a number of transmission gears disposed between the second driven gear and the second drive gear, and a number of transmission gears disposed between the first driven gear and the third drive gear are not all even numbers or odd numbers, wherein zero is assumed to be an even number.

3. The sheet feeder according to claim 1, wherein at least two of the first, second, and third drive gears mesh directly with the corresponding first and second driven gears to transmit the rotational driving force thereto, and the other of the first, second, and third drive gears is operatively associated with the corresponding driven gear via a transmission gear to transmit the rotational driving force thereto.

4. The sheet feeder according to claim 1, wherein the first and second rollers are coaxially supported.

5. The sheet feeder according to claim 1, wherein one of the first and second rollers includes a pipe, and the other one of the first and second rollers includes a shaft passing through and supported by the pipe.

6. The sheet feeder according to claim 1, wherein the first driven gear is disposed on the first roller.

7. The sheet feeder according to claim 1, wherein the second driven gear is disposed on the second roller.

8. The sheet feeder according to claim 1, wherein gears having the same number of teeth and the same module are disposed on the first and second rollers.

9. The sheet feeder according to claim 1, wherein the first and second drive gears have the same number of teeth and the same module.

10. The sheet feeder according to claim 1, wherein the second and third drive gears have the same number of teeth and the same module.

11. The sheet feeder according to claim 1, wherein each of the first and second drive units comprises an input gear.

12. The sheet feeder according to claim 1, wherein the first drive unit includes a central gear rotatable by the rotational driving force from the power source, a lever swingable about the central gear, and at least one gear rotatably supported by the lever, the at least one gear being capable of simultaneously meshing with the first drive gear and the second drive gear.

13. The sheet feeder according to claim 1, wherein the second drive unit includes a central gear rotatable by the rotational driving force from the power source, a lever swingable about the central gear, and at least one gear rotatably supported by the lever, the at least one gear being capable of simultaneously meshing with the second drive gear and the third drive gear.

14. The sheet feeder according to claim 1, wherein the power source includes a single motor.

15. The sheet feeder according to claim 1, wherein the first and second rollers rotate in the same direction when the first drive unit simultaneously meshes with the first drive gear and the second drive gear so as to input the rotational driving force from the power source to the first drive gear and the second drive gear, and the first and second rollers rotate in opposite directions when the second drive unit simultaneously meshes with the second drive gear and the third drive gear so as to input the rotational driving force from the power source to the second drive gear and the third drive gear.

16. An image-forming apparatus comprising:

an image-forming unit configured to form an image on a sheet according to predetermined information; and the sheet feeder according to claim 1.

17. An image-reading apparatus comprising:

an image-reading unit configured to read an image from a sheet; and the sheet feeder according to claim 1.

18. The sheet feeder according to claim 1, wherein the first drive gear transmits the rotational driving force from the first drive unit to the first driven gear, the second drive gear transmits the rotational driving force from the first drive unit or the second drive unit to the second driven gear, and the third drive gear transmits the rotational driving force from the first drive unit to the first driven gear.

19. The sheet feeder according to claim 18, wherein a rotational axis of the first roller is the same as a rotational axis of the second roller.

20. The sheet feeder according to claim 19, wherein a pipe of either one of the first roller and the second roller supports an axis of the other roller, the axis of the other roller penetrating the pipe of either one of the first roller and the second roller.

21. A sheet feeder comprising:

first and second rollers configured to apply a feeding force to a sheet;

a first driven gear configured to transmit a rotational driving force to the first roller;

a second driven gear configured to transmit the rotational driving force to the second roller;

a first drive gear configured to transmit the rotational driving force to the first driven gear;

a second drive gear configured to transmit the rotational driving force to the second driven gear;

a third drive gear configured to transmit the rotational driving force to the first driven gear;

a first drive unit switchable between a meshing state, in which the first drive unit simultaneously meshes with the first drive gear and the second drive gear, and an escape state, in which the first drive unit does not mesh with the first drive gear or the second drive gear;

a second drive unit switchable between the meshing state, in which the second drive unit simultaneously meshes with the second drive gear and the third drive gear, and the escape state, in which the second drive unit does not mesh with the second drive gear or the third drive gear;

a power source inputting the rotational driving force to the first drive unit and the second drive unit; and a control unit configured to switch the first drive unit to the meshing state and the second drive unit to the escape state so as to input the rotational driving force from the first drive unit to the first drive gear and the second drive gear and to switch the first drive unit to the escape state and the second drive unit to the meshing state so as to input the rotational driving force from the second drive unit to the second drive gear and the third drive gear, wherein the rotational driving force is input from the power source to the first drive unit so as to rotate the first and second rollers in opposite directions or is input from the power source to the second drive unit so as to rotate the first and second rollers in the same direction, and wherein when the first and second rollers rotate in the same direction, the sheet is conveyed in a direction, and when the first and second rollers rotate in opposite directions, the sheet is turned about an axis parallel to a direction normal to the surface thereof.

22. The sheet feeder according to claim 21, wherein the first drive gear transmits the rotational driving force from the first drive unit to the first driven gear, the second drive gear transmits the rotational driving force from the first drive unit or the second drive unit to the second driven gear, and the third drive gear transmits the rotational driving force from the first drive unit to the first driven gear.

23. The sheet feeder according to claim 22, wherein a rotational axis of the first roller is the same as a rotational axis of the second roller.

24. The sheet feeder according to claim 23, wherein a pipe of either one of the first roller and the second roller supports an axis of the other roller, the axis of the other roller penetrating the pipe of either one of the first roller and the second roller.

* * * * *